US006566985B2

(12) United States Patent
Niiranen et al.

(10) Patent No.: US 6,566,985 B2
(45) Date of Patent: May 20, 2003

(54) HIGH-PASS FILTER

(75) Inventors: Erkki Niiranen, Ii (FI); Tapani Vistbacka, Kempele (FI)

(73) Assignee: Filtronic LK OY, Kempele (FI)

( * ) Notice: Subject to any disclaimer, the term of this patent is extended or adjusted under 35 U.S.C. 154(b) by 0 days.

(21) Appl. No.: 09/956,657

(22) Filed: Sep. 19, 2001

(65) Prior Publication Data

US 2002/0036552 A1 Mar. 28, 2002

(30) Foreign Application Priority Data

Sep. 22, 2000 (FI) ..... 20002090

(51) Int. Cl.[7] ..... H01P 1/205
(52) U.S. Cl. ..... 333/202; 333/203; 333/204
(58) Field of Search ..... 333/202, 134, 333/204, 203

(56) References Cited

U.S. PATENT DOCUMENTS

| | | | | |
|---|---|---|---|---|
| 4,179,673 A | | 12/1979 | Nishikawa et al. | |
| 5,124,675 A | * | 6/1992 | Komazaki et al. | 333/204 |
| 5,307,036 A | * | 4/1994 | Turunen et al. | 333/202 |
| 5,379,011 A | * | 1/1995 | Sokola et al. | 333/206 |
| 5,689,221 A | * | 11/1997 | Niiranen et al. | 333/202 |
| 5,929,721 A | * | 7/1999 | Munn et al. | 333/202 |
| 6,255,917 B1 | * | 7/2001 | Scott | 333/202 |

FOREIGN PATENT DOCUMENTS

| | | | |
|---|---|---|---|
| JP | 9232805 | 9/1997 | H01P/1/203 |

* cited by examiner

*Primary Examiner*—Don Le
*Assistant Examiner*—Lam T. Mai
(74) *Attorney, Agent, or Firm*—Darby & Darby

(57) ABSTRACT

The invention relates to a high-pass filter realized in a conductive casing by means of mechanical structural elements, which filter is suitable for signal processing especially at microwave frequencies. In the casing (201, 202, 203) there are in series rigid conductive elements (2IN, 210, 220, 230, 2OUT) separated from each other. Between successive elements there is capacitance that can be adjusted within certain limits, if necessary. The insulating material between the elements is air or plastic, for example. At least some of the conductive elements involve a conductor (214, 224) less than half a wavelength long, short-circuited at the opposite end to the casing. This together with the casing connected to the signal ground provides a transmission line which, looking from the conductive element, is inductive at the operating frequencies. A signal path is thus provided in the filter with capacitance in the longitudinal direction and inductance in the transversal direction between each two capacitive elements. The structure is simple and sturdy, which means relatively good power handling capacity and reliability. In addition, the structure has few boundaries that may cause harmful intermodulation.

13 Claims, 4 Drawing Sheets

HIGH-PASS FILTER

The invention relates to a filter realized in a conductive case by means of mechanical structural elements, which filter is suitable for signal processing especially at microwave frequencies.

In present and future mobile communication networks more is required of filters than that their frequency responses comply with specifications. Low losses is a characteristic which is at least desirable in most filters. Low losses mean low attenuation in the pass band and easier matching. Good breakdown characteristics and power handling capacity are often required as well. For example, in WCDMA (Wideband Code Division Multiple Access) devices the strength of the electric field of the transmitted signal has instantaneous peaks which may cause breakdowns in the insulator. Strict requirements on the power handling capacity of a filter may be imposed especially in cases where a plurality of transmitted signals are summed. In the filter should not occur intermodulation to a harmful extent when signals at different frequencies travel through it. Furthermore, in the case of series manufactured filters that meet the requirements it is essential to bring the production costs down as much as possible.

Figure 1:
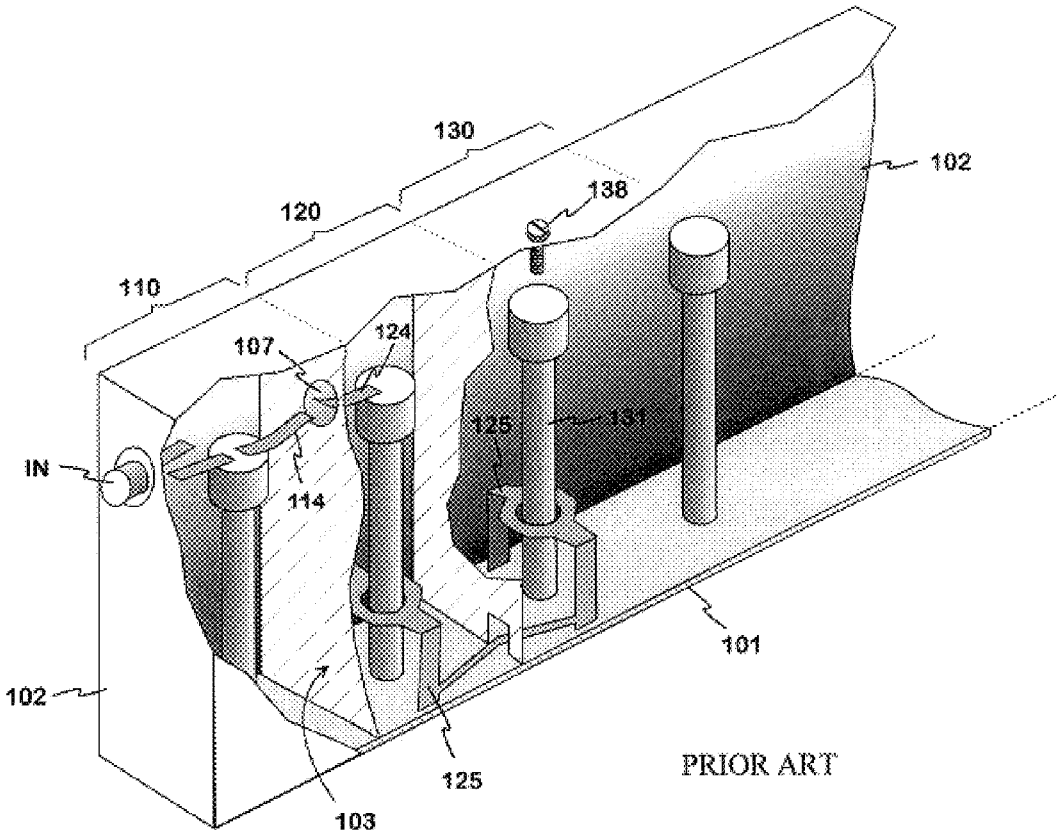

There is a multitude of different known filter structures. The structure discussed in this description resemble to an extent filters consisting of resonators formed in a metal casing by means of mechanical structural elements. The resonators are usually arranged in a row so that they constitute a single block when viewed from the exterior. The most common resonator type is the coaxial quarter-wave resonator. Inter-resonator coupling, which is accomplished by means of auxiliary parts, is either capacitive or inductive. Coupling mechanism details may vary to a great extent. FIG. 1 shows an example of such a prior-art filter partly opened and disassembled. It comprises resonators, such as 110, 120 and 130, in a row. Each resonator comprises an inner conductor, such as 131, galvanically coupled at its lower end to the bottom plate 101 of the structure. The inner conductors may have extensions at their upper ends in order to increase the capacitance at the open end of the structure, thereby causing the resonator can be made shorter in the vertical dimension. Each resonator further comprises an outer conductor consisting of resonator partition walls, such as 103, and parts 102 of the side walls and end walls of the whole filter case. The structure includes a conductive cover so that the filter casing is closed. By way of example, the cover is provided with a screw 138 at resonator 130 for tuning the resonance frequency of that resonator. FIG. 1 shows by way of example one capacitive and one inductive coupling between the resonators. The capacitive coupling is between resonators 110 and 120 at their open ends where the electric field is relatively strong. For the capacitive coupling there is an aperture 107 in the wall 103 between the resonators 110 and 120. Conductive wings 114, 124 attached to the inner conductors of the resonators and directed towards the aperture add to the inter-resonator coupling capacitance. Input to the filter via connector IN is also capacitive. The inductive coupling is between resonators 120 and 130, near their short-circuited ends where the magnetic field is relatively strong. For the inductive coupling there is an element 125 shaped of conductive plate, which extends close to the inner conductors of said resonators and is grounded at suitable points. The element 125 produces mutual inductance between the resonators. A disadvantage of the structure described and like structures is the difficulty of filter tuning and the costs that follow therefrom.

Moreover, the manufacturing prior to the tuning involves relatively high costs as well. Furthermore, there is a danger of generating harmful intermodulation results, especially if the structures employ more than one metal for the purpose of temperature compensation.

An object of the invention is to alleviate said disadvantages associated with the prior art. The structure according to the invention is characterized by that which is specified in the independent claim 1. Some preferred embodiments of the invention are specified in the other claims.

The basic idea of the invention is as follows: A metal casing houses a series of separated rigid conductive elements. Between the consecutive elements there is arranged a suitable capacitance which is adjustable within certain limits, if necessary. At least some of the conductive elements are connected with, or they include, a conductor less than half a wavelength long, short-circuited at the opposite end. Together with the casing connected to the signal ground the conductor constitutes a transmission line which, looking from the conductive element, is inductive at the operating frequencies. This way a signal path is provided in the filter, having capacitance in the longitudinal direction and inductance in the transversal direction, always between two capacitive parts. The structure is a high-pass type structure.

An advantage of the invention is that the filter structure according to it is simple in comparison with structures according to the prior art. This means savings in manufacturing costs. Another advantage of the invention is that the structure according to it is sturdy in comparison with the prior art. This means relatively good power handling capacity and reliability. A further advantage of the invention is that the structure according to it, in comparison with the prior art, has less boundaries that may cause harmful intermodulation.

Figure 3:
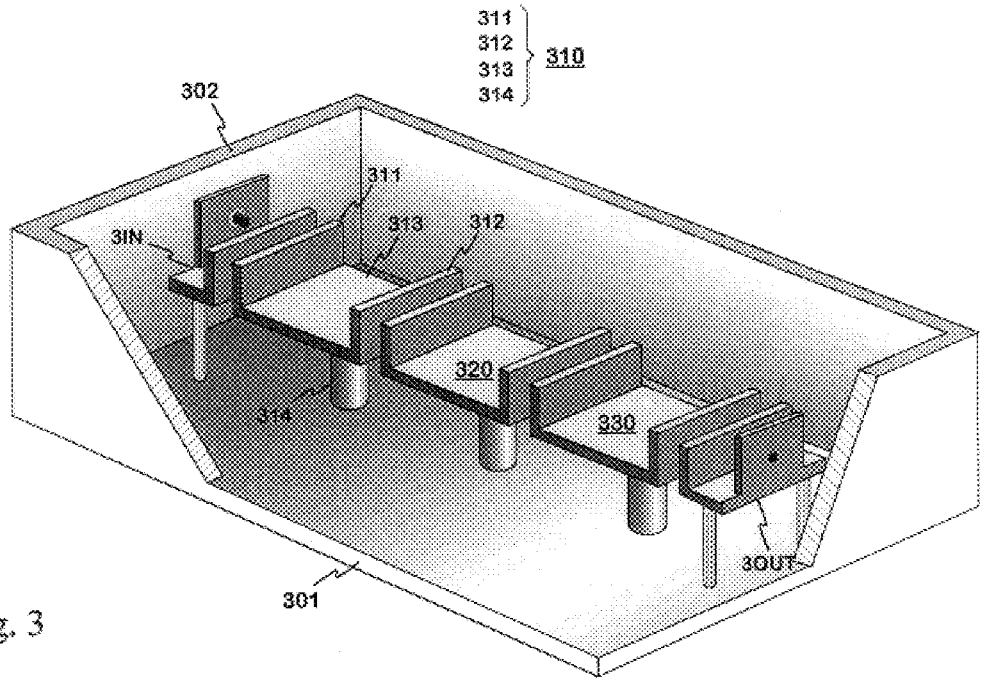
Figure 4:
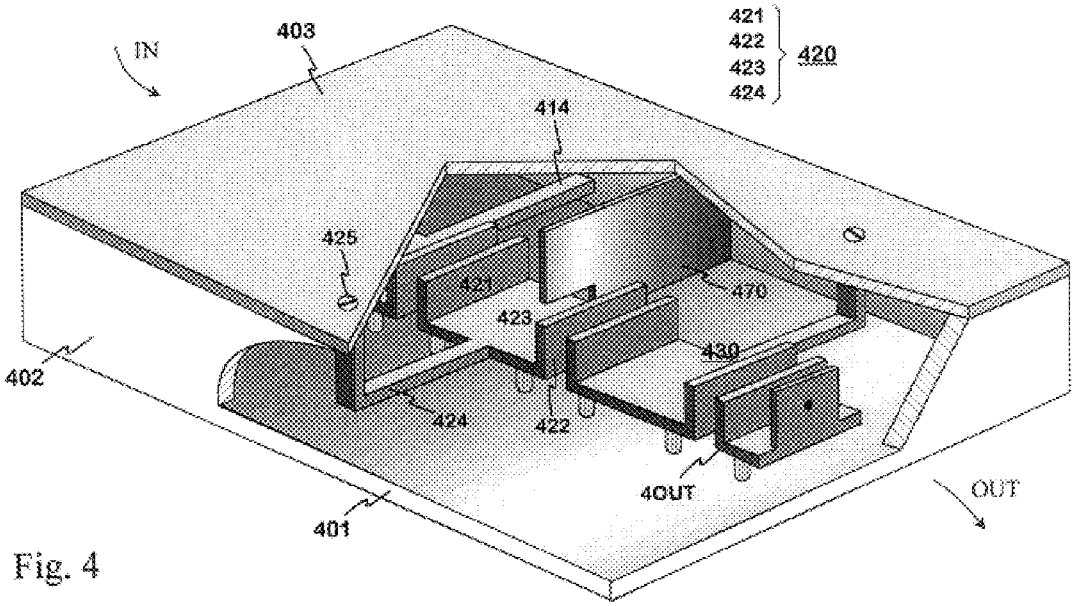
Figure 5:
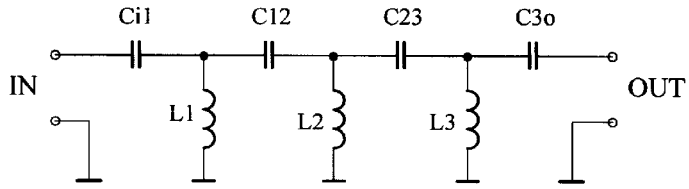
Figure 6:
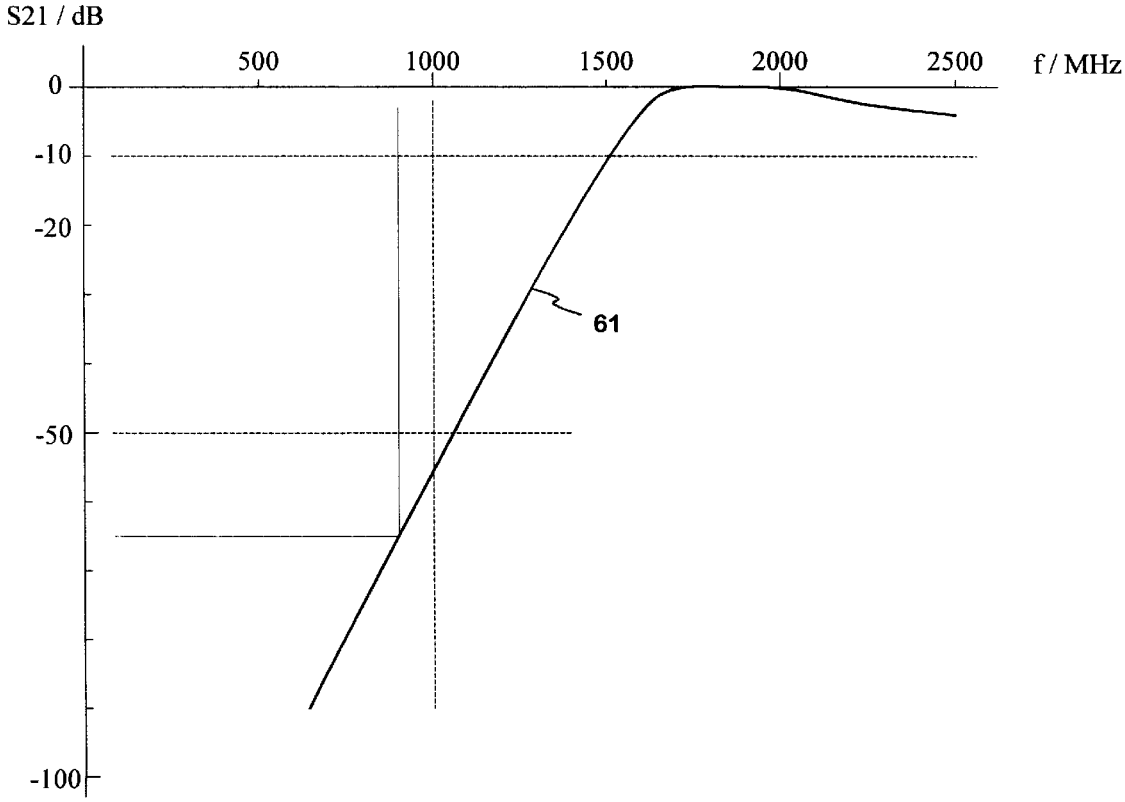

The invention is below described in closer detail. The description refers to the appended drawings in which FIG. 1 shows an example of a filter structure according to the prior art, FIGS. 2*a,b* show an example of a filter structure according to the invention, FIG. 3 shows a second example of a filter structure according to the invention, FIG. 4 shows a third example of a filter structure according to the invention, FIG. 5 shows an equivalent circuit of a structure according to the invention, and FIG. 6 shows an example of the amplitude response of a filter according to the invention.

FIG. 1 was already discussed in connection with the description of the prior art.

Figure 2A:
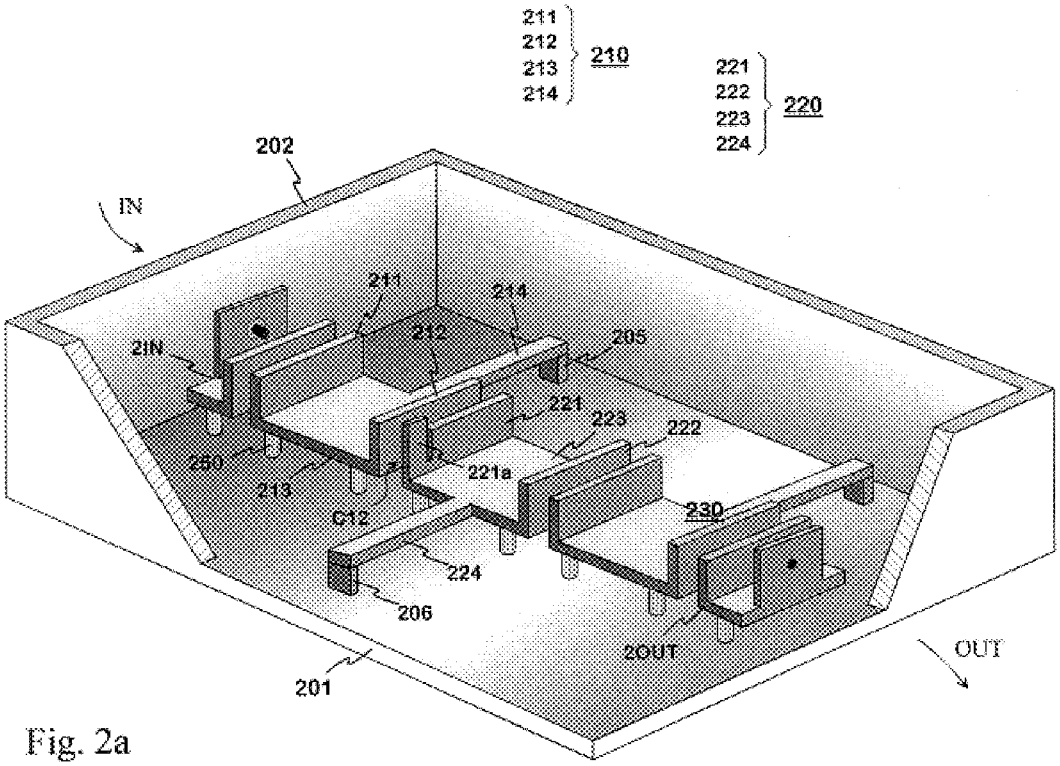

FIG. 2*a* shows an example of a structure according to the invention. The Figure shows a conductive casing, cut open and the cover removed, in which the bottom 201 and frame 202 form a single piece. The signal is brought in at the end which in the Figure is the farther end and taken out at the opposite end, which in the Figure is the nearer end. In the casing there are, successively in the longitudinal direction, starting from the input end of the filter, an input conductor 2IN, three mutually alike filtering units 210, 220 and 230, and an output conductor 2OUT. The first filtering unit 210 comprises a horizontal part 213 rectangular in the horizontal plane, vertical parts 211, 212 transversal in the vertical plane, located at opposing ends in the longitudinal direction of the horizontal part, and an oblong conductive protrusion 214 transversal in the horizontal plane, extending out from the middle of a longitudinal side of the horizontal part 213. Such a piece may be produced e.g. by first cutting a suitably shaped planar piece from a rigid metal plate and then bending the protrusions corresponding to the vertical parts at a right angle. The first filtering unit is supported by insulating elements, such as 250, so that it is elevated from the bottom of the casing.

"Longitudinal direction" means in this description and in the claims the direction of the center line of the bottom of the filter casing from the input end of the filter towards the output end thereof. Correspondingly, "transversal direction" means the direction perpendicular to the longitudinal direction in the horizontal plane. Further, "horizontal plane" means in this description and in the claims the plane parallel to the bottom of the filter casing, "vertical direction" means the direction perpendicular to the bottom of the filter casing, and "vertical plane" means the plane perpendicular to the bottom of the filter casing.

Together with the casing, which provides a signal ground, said conductive protrusion 214 forms a transmission line. Let the conductive protrusion part of such transmission lines be called a transmission conductor. At its outer end the transmission line is short-circuited by means of a conductive piece 205 extending to the bottom 201 of the casing. The length of the transmission line is chosen such that at the filter operating frequencies and stop-band frequencies half a wavelength is greater than the length of the transmission line. The short-circuited transmission line is then inductive as measured at the starting end. Also the horizontal part 213 provides in principle a short transmission line together with the bottom of the case. The distance of the horizontal part from the bottom of the case is chosen such that the "line" impedance is e.g. 50 ohm.

The second filtering unit 220 correspondingly comprises a horizontal part 223, a first vertical part 221, a second vertical part 222, and a transversal transmission conductor 224 connected to the ground at its outer end. The first vertical part 221 of the second filtering unit and the second vertical part 212 of the first filtering unit face each other and are located relatively close to one another. Thus they form an air-insulated capacitor with a certain capacitance C12. A similar capacitive coupling exists between the second and third filtering units. A similar capacitive coupling also exists between the third filtering unit and said output conductor 2OUT as well as at the input end of the filter between said input conductor 2IN and the first filtering unit. The vertical part 221 has a relatively narrow part 221a separated by a vertical slot, which narrow part can be bent in order to fine-tune the capacitance C12. If necessary, the fine-tuning of the other series capacitances can be arranged similarly.

Figure 2B:
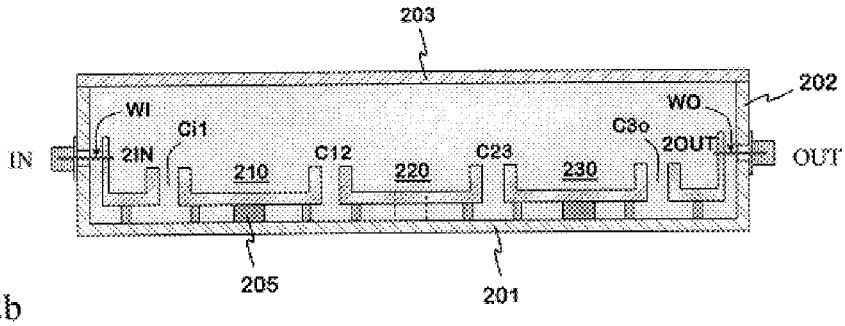

FIG. 2*b* shows a longitudinal section of the structure depicted in FIG. 2*a*. Shown in the Figure are the bottom 201, frame 202 and the cover 203 of the filter casing. On the signal path there are, in this order, the input conductor 2IN, three filtering units 210, 220, 230 and the output conductor 2OUT. Between these there are, respectively, the capacitances C11, C12, C23 and C3o. The Figure also shows a wire WI that connects the inner conductor of the coaxial input connector to the input conductor 21N, and a wire WO which connects the output conductor 2OUT to the inner conductor of the coaxial output connector. The outer conductors of the input and output connectors are in galvanic contact with the filter casing.

FIG. 3 shows a second example of a structure according to the invention. Depicted is a filter casing, cut open, with a bottom 301 and frame 302. In the casing there are, successively in longitudinal direction, starting from the input end of the filter, an input conductor 3IN, three mutually alike filtering units 310, 320 and 330, and an output conductor 3OUT. The first filtering unit 310 comprises a horizontal part 313 rectangular in the horizontal plane, vertical parts 311, 312 transversal in the vertical plane, located at opposing ends in the longitudinal direction of the said horizontal part, and a vertical transmission conductor 314, in this example cylindrical, extending from the lower surface of the horizontal part 313 to the bottom of the casing. The difference with respect to the structure of FIG. 2 is that the vertical conductor 314 replaces both the horizontal transversal transmission conductor 214 and the short-circuit piece 205. Thus there is no need for a special short-circuit piece. From the manufacturing standpoint it is advantageous to produce the vertical conductors of all the filtering units e.g. by extrusion so that they are protrusions from the bottom 301 of the casing and form a single piece with the bottom and frame. To these protrusions the filter unit parts, which have a longitudinal section resembling a broad U, are attached e.g. by soldering or with screws. The vertical conductors may be so strong that special supportive elements are not needed for the filtering units.

FIG. 4 shows a third example of a structure according to the invention. This is similar to the structure of FIG. 2 with the following differences: The transversal transmission conductor 424 of the second filtering unit 420 turns upwards providing a short-circuit to the cover 403 of the filter casing instead of the bottom. Attachment to the cover of the casing is realized by means of a screw 425. The upward-pointing part forms in this example a single piece with the second filtering unit 420. Also the transmission conductor of the third filtering unit 430 extends to the cover of the filter case. Instead the transmission conductor 414 of the first filtering unit goes straight to the side wall of the case. The structure of FIG. 4 additionally comprises a conductive partition wall 470. It is of the same height as the inner space of the casing and extends in the transversal direction from the side wall of the casing close to the second filtering unit, partly above it. The aim of the partition wall 470 is to weaken undesired electromagnetic coupling between the filtering units.

In the examples of FIGS. 2, 3 and 4 the capacitors in the structures are air-insulated. The insulator may naturally be some dielectric material, in which case the desired capacitance values can be realized with capacitors of smaller size. The insulator blocks may be produced e.g. by means of injection moulding, using plastics of suitable permittivity. Such insulator blocks may be shaped so that there is no need for special dielectric support elements for filter units, such as element 250 in FIG. 2*a*.

FIG. 5 shows a simplified equivalent circuit corresponding to the structures of FIGS. 2, 3 and 4 discussed above. In the equivalent circuit the second poles of the filter input port IN and output port OUT are connected to the signal ground. Between the first poles of the input and output port there are, connected in series, capacitors Ci1, C12, C23 and C3o, in that order. Of these, Ci1 corresponds to the capacitance between the input conductor, such as 2IN, and the first filtering unit, C12 corresponds to the capacitance between the first and second filtering units, C23 to the capacitance between the second and third filtering units, and C3o corresponds to the capacitance between the third filtering unit and the output conductor, such as 2OUT. The equivalent circuit further comprises three coils, each with one end in the signal ground: Coil L1 is connected to the signal ground between capacitors CiI and C12, coil L1 between capacitors C12 and C23, and coil L3 between capacitors C23 and C3o. Coil L1 corresponds to the inductance constituted by the transmission line associated with the first filtering unit, coil L2 to the inductance constituted by the transmission line associated with the second filtering unit, and coil L3 corresponds to the inductance constituted by the transmission line associated with the third filtering unit. The inductance values depend on the frequency, being based on a short-circuited transmission line. The ladder structure according to FIG. 5 with series capacitance and cross inductance is, as known, by nature a high-pass type structure.

FIG. 6 shows an example of the amplitude response of a filter according to the invention. The vertical axis represents parameter S21 which characterizes signal attenuation in the filter. The variable on the horizontal axis is frequency. Curve 61 shows that attenuation over the frequency range 1.7 to 2.0 GHz is very low.

Attenuation increases rapidly from 1.6 GHz down. For example, at 900 MHz the attenuation already is about 65 dB. Above 2 GHz the attenuation increases a little; e.g. at 2.5 GHz it is about 4 dB. A filter with this kind of response is suitable as an antenna filter part that passes e.g. the signals of the GSM1800 system but stops GSM900 signals when using a dual-band antenna.

The result presented in FIG. 6 applies to a structure comprising three filtering units in accordance with the examples discussed above. The steep slope of the attenuation curve 61 below the pass band is reached when the structure is made to function according to Chebyshev approximation in the frequency band in question.

Above it was described some solutions according to the invention. The invention is not limited solely to those. The elements constituting the filtering units may be shaped in many ways: They may be e.g. rectangular prisms from which the transmission conductor starts or they may have curved edges. Their quantity is naturally freely selectable. Nor does the invention limit the manufacturing method of the structure. The inventional idea may be applied in different ways within the scope defined by the independent claim.

What is claimed is:

1. A high-pass filter consisting of capacitive parts in series in signal path and inductive parts crosswise in signal path, and comprising in a closed conductive casing, which includes a bottom, side and end walls and a cover, successively in the longitudinal direction in the signal path at least a first and a second filtering unit, wherein said filtering units are rigid conductive pieces, said capacitive part is provided with portions of the first and second filtering unit, between which portions there is a capacitive coupling and said inductive part is provided with a transmission conductor included in each filtering unit, the transmission conductor being galvanically connected by one of its ends to said casing.

2. The high-pass filter according to claim 1, whereby each filtering unit comprises a horizontal part substantially in the horizontal plane, a transversal first vertical part substantially in the vertical plane at the first end of the horizontal part in the longitudinal direction, and a transversal second vertical part substantially in the vertical plane at the second end of the horizontal part in the longitudinal direction, and the second vertical part of the first filtering unit and the first vertical part of the second filtering unit face one another and are insulated from each other.

3. The high-pass filter according to claim 1, whereby the transmission conductor of at least one filtering unit is substantially transversal.

4. The high-pass filter according to claim 1, whereby the transmission conductor of at least one filtering unit is substantially vertical.

5. The high-pass filter according to claim 3, whereby at the outer end of the transmission conductor there is a conductive piece to galvanically connect the transmission conductor to the bottom of the filter casing.

6. The high-pass filter according to claim 3, whereby at the outer end of the transmission conductor there is a conductive piece to galvanically connect the transmission conductor to the cover of the filter casing.

7. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and whereby the transmission conductor of at least one filtering unit is substantially transversal, and whereby the transmission conductor extends substantially straight to a side wall of the filter casing to galvanically connect the transmission conductor to the filter casing.

8. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and whereby the transmission conductor of at least one filtering unit is substantially vertical, and whereby the transmission conductor forms one single piece together with the bottom of the filter casing.

9. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and which structure further comprises an input conductor element galvanically coupled to an input conductor of the filter and capacitively coupled to the first filtering unit, and an output conductor element galvanically coupled to an output conductor of the filter and capacitively coupled to the last filtering unit in the longitudinal direction.

10. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and whereby the length of the transmission conductor is smaller than half the wavelength at the cut-off frequency of the filter.

11. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and which structure further comprises at least one conductive partition wall insulated from the filtering units to restrict electromagnetic coupling.

12. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and whereby an insulating material between the filtering units is substantially air.

13. A filter structure comprising in a closed conductive casing, which includes a bottom, side and end walls and a cover, successively in the longitudinal direction at least a first and a second filtering unit, whereby said filtering units are rigid conductive pieces, between the first and second filtering unit there is capacitive coupling and each filtering unit comprises a transmission conductor galvanically connected by one of its ends to the said casing, and whereby an insulating material between the filtering units is substantially plastic.

* * * * *